US007793858B2

(12) United States Patent
Heldt et al.

(10) Patent No.: US 7,793,858 B2
(45) Date of Patent: Sep. 14, 2010

(54) PAINT DELIVERY AND APPLICATION APPARATUS AND METHOD

(75) Inventors: Robert F. Heldt, Oxford, MI (US); Rainer Melcher, Oberstenfeld (DE); Manfred Michelfelder, Höpfigheim (DE); Robert E. Brady, West Bloomfield, MI (US)

(73) Assignee: Durr Systems, Inc., Plymouth, MI (US)

( * ) Notice: Subject to any disclaimer, the term of this patent is extended or adjusted under 35 U.S.C. 154(b) by 0 days.

(21) Appl. No.: 11/661,629

(22) PCT Filed: Jan. 10, 2005

(86) PCT No.: PCT/US2005/000605

§ 371 (c)(1),
(2), (4) Date: Aug. 16, 2007

(87) PCT Pub. No.: WO2006/043960

PCT Pub. Date: Apr. 27, 2006

(65) Prior Publication Data

US 2008/0023571 A1 Jan. 31, 2008

(51) Int. Cl.
*B05B 17/00* (2006.01)

(52) U.S. Cl. ..... 239/1; 239/106; 239/112; 239/116; 239/123; 239/303; 239/305; 118/684; 137/563; 427/426

(58) Field of Classification Search ..... 239/1, 239/3, 104, 106, 112, 114, 116, 123, 302–305, 239/690, 700; 118/633, 684; 137/563, 565.01, 137/572; 427/421.1, 426
See application file for complete search history.

(56) References Cited

U.S. PATENT DOCUMENTS

| | | | | |
|---|---|---|---|---|
| 3,108,012 | A | 10/1963 | Curtis | |
| 4,390,126 | A * | 6/1983 | Buchholz et al. | 239/1 |
| 6,037,010 | A * | 3/2000 | Kahmann et al. | 239/116 |
| 6,582,774 | B2 * | 6/2003 | Klein et al. | 427/426 |
| 6,589,348 | B2 * | 7/2003 | Ott | 118/684 |

FOREIGN PATENT DOCUMENTS

| | | |
|---|---|---|
| DE | 19830029 | 1/2000 |
| EP | 1 172 153 B1 | 8/2003 |
| WO | 03095106 | 11/2003 |

OTHER PUBLICATIONS

Supplementary European Search Report.

* cited by examiner

*Primary Examiner*—Steven J Ganey
(74) *Attorney, Agent, or Firm*—Howard & Howard Attorneys PLLC

(57) ABSTRACT

A paint delivery and application apparatus, wherein the apparatus includes a source of paint, a paint applicator, a supply line interconnecting the source of paint and the applicator and at least one pig in the supply line, wherein the paint pushes the pig from adjacent the source of paint to the paint applicator and a source of purging solvent delivering a small volume of purging solvent to the supply line when the pig is adjacent the source of paint adjacent to and upstream of the pig acting as a lubricant, reducing chattering and skipping of the pig and extending the life of the pig. Where the apparatus includes two pigs, purging solvent is delivered between the pigs adjacent the applicator, the pigs are delivered to adjacent the source of paint and a small volume of solvent is then delivered from between the pigs upstream of the pigs.

25 Claims, 9 Drawing Sheets

PAINT DELIVERY AND APPLICATION APPARATUS AND METHOD

FIELD OF THE INVENTION

The present invention relates to paint or coating delivery and application systems and apparatus using pigging technology and methods of delivering and applying paint to a substrate or a plurality of substrates, reducing the problems associated with the present technology, including reducing the pressure required to push pigging elements through delivery lines, reducing chatter, skipping and jumping of pigging elements in delivery lines and improving cleaning of paint residue in delivery lines.

BACKGROUND OF THE INVENTION

The prior art discloses numerous paint delivery and application systems, including systems using pigging technology. Such systems may, for example, be used to apply seriatim, paints of different color to a plurality of substrates, such as vehicle bodies on a moving conveyor in a paint spray booth. The term "paint," as used herein includes solvent or water base paints used to paint or coat a substrate and generically any coating, including protective coatings, which may be applied to a substrate using an applicator, such as a sprayer or rotary atomizer. Depending on its function in the coating delivery system, pigs or pigging elements are variously referred to in the prior art as pigs, shuttles, separating elements, terminating pistons, plugs, etc. For the purposes of this application, the term pigging element is used. Generally, a pigging element is utilized in prior art paint delivery systems to push paint either toward the applicator to apply the paint, separate different paints or solvents, separate or clean the paint supply lines or push paint in the supply lines back to the paint switching device or color changer. Pigging elements have also been used to separate fluids in a delivery line including paints of different colors, solvents, viscous liquids, oils, etc. which may be driven through the delivery line by pneumatic pressure or other fluid.

A conventional paint supply and application system includes a source of paint under pressure, an applicator, such as a rotary atomizer or sprayer, generally at high voltage where the paint is conductive and applied with an electrostatic rotary atomizer, a source of solvent under pressure and a supply line or lines connecting the source of paint and solvent to the applicator. Where the source of paint and solvent includes a color changer or paint supply switching device, the paint supply and application system may also include a paint cannister which may be mounted on a robot, for example, and the color changer is generally at ground potential. When a second paint is to be applied, the cannister may be switched for a cannister filled with a different paint or the cannister may be connected to a source of different paint. As used herein, the term "cannister" or "paint cannister" includes any container suitable for receipt and delivery of paint.

A paint delivery and application system or apparatus using pigging technology for application of different paints, as disclosed in the prior art, typically includes a color changer or paint supply switching device, including sources of different paints and a source of solvent under pressure, a paint applicator, such as a rotary atomizer, a supply line connected to the color changer and the applicator and a pigging element which is received in the supply line to push paint through the supply line either toward the paint applicator to apply paint to a substrate or from adjacent the paint applicator to the color changer to recover paint in the supply line. As the pigging element moves through the supply line, it pushes paint or solvent through the supply line and cleans or scrapes paint or solvent from the supply line. In one embodiment disclosed in the prior art, for example, a pigging element is inserted in the supply line to push paint from a color changer to the applicator and the pigging element is then removed. In another embodiment disclosed in the prior art, the supply line between the paint supply switching device and the applicator includes two pig receiver stations, including a first pig station adjacent the paint supply switching device or color changer and a second pig station adjacent the paint applicator. The pig receiver stations are defined by a chamber which permits paint or solvent to flow around the pigging element. The pigging element is releasably retained in the first pig station by a clamping means and then released to push paint from the first pig receiver station adjacent the paint applicator to push paint in the supply line to the paint applicator. The pigging element is then driven back under pneumatic pressure to the first receiving station to push paint in the supply line back to the paint supply and switching device or color changer to recover paint in the supply line.

Co-pending PCT Application WO 03/14471 filed May 6, 2003 discloses significant improvements in paint delivery and application systems and methods, wherein a preferred embodiment includes a conventional color changer or paint supply switching device at ground potential preferably having at least two sources of paint under pressure, at least two paint canisters, a paint applicator, a first pair of separate supply lines connecting the color changer and the paint cannisters and a second pair of separate supply lines connecting the cannisters to the paint applicator. Thus, with the disclosed embodiment of the paint delivery and application system, a first paint may be supplied from a first paint cannister to the paint applicator while a second paint is supplied from the color changer to a second cannister, significantly reducing the cycle time and electrostatically isolating the paint applicator from the color changer or other source of paint. Further, where this system includes pigging technology, a preferred embodiment includes a pig station adjacent each of the paint cannisters, which provides a source of paint under pressure, and a second pig station adjacent the paint applicator. In one preferred embodiment, two pigging elements are located in the second supply lines between the paint cannisters and the paint applicator and solvent may be received between the pigging elements, such that paint under pressure is directed against the pigging elements from the paint cannisters, driving the pigging elements from the first pig station to the second pig station where solvent is located between the pigging elements, the system results in cleaning or purging the supply line and the paint applicator and then directing paint under pressure to the paint applicator, which applies paint to a substrate.

In a preferred embodiment, the pigging elements include annular generally frustoconical skirt portions adjacent the opposed ends having a diameter greater than the supply lines to scrape the supply lines of residue paint from the prior application. However, it has been found that the pigging elements in such applications "chatter" in the delivery lines, skipping and jumping through the delivery lines, which is a particular problem with paint delivery and application systems requiring precise metering of the paint delivered to the applicator, although it is also a problem with other coating applicators requiring accurate metering of the coating. Another problem with such delivery and application systems is wear of the pigging elements. In a preferred embodiment, the pigging elements also include a sensor element, such as a magnet, to permit precise determination of the location of the pigging element in the supply line. Thus, the pigging elements used in such delivery systems are relatively expensive and the pigging elements must be discarded, if worn or damaged.

As will be understood by those skilled in this art, the delivery lines between the source of paint under pressure and the paint applicator may be 14 to 16 meters in length or greater and the pigging elements must be driven from the source of paint to the paint applicators through the delivery lines and typically returned from the paint applicator to the source of paint with each application of paint. In a typical application, the delivery lines are flexible. Thus, the pigging elements must be rapidly delivered through the delivery lines with each application of paint and skipping or jumping of the pigs through the delivery lines is a particular, but not exclusive problem with paint delivery and application apparatus. The paint delivery and application apparatus and method of this invention eliminates the problem of skipping or jumping of the pigging elements through the delivery lines from the source of paint to the paint applicator, resulting in more accurate metering of the paint, reducing wear of the pigging elements and extending the life of the pigging elements in such applications.

SUMMARY OF THE INVENTION

The paint delivery and application apparatus or system of this invention includes a source of paint under pressure, a paint applicator adapted to apply paint to a substrate, such as a rotary atomizer used by the automotive industry to apply paint to vehicle bodies or other paint spray device, such as a paint spray gun, a supply line interconnecting the source of paint with the paint applicator, at least one pigging element in the supply line moveable from adjacent the source of paint under pressure to the paint applicator, wherein in one preferred embodiment paint pushes the pigging element from adjacent the source of paint to adjacent the paint applicator to apply paint to a substrate, and a source of purging solvent delivering a small volume of purging solvent ahead or upstream of the pigging element when the pigging element is located adjacent the source of paint and prior to delivering paint to the supply line. The small volume of purging solvent in this application provides several important advantages in the paint delivery and application apparatus of this invention over the prior art. First, the small volume of purging solvent delivered to the supply line upstream of the pigging element prevents chattering, skipping or jumping of the pigging element in the supply line, which is particularly important where a predetermined volume of paint must be delivered to the paint applicator. Second, the delivery of a small volume of purging solvent upstream of the pigging element serves as a lubricant, reducing wear of the pigging element. As will be understood by those skilled in this art, pigging elements of the type used in paint delivery and application apparatus are relatively expensive, typically including a sensing element, such as a magnet, encapsulated in the pigging element, and the pigging element includes an annular portion or portions having a diameter greater than the internal diameter of the delivery line. In the disclosed embodiment of the pigging element, the pigging element includes annular frustoconical ribs or skirt portions which scrape the internal surface of the delivery line. Thus, any wear or distortion of the ribs or skirt portions will reduce the effectiveness of the pigging elements, requiring replacement. Further, the delivery line between the source of paint and the paint applicator is preferably flexible and may be sixteen meters or greater in length. Finally, the pigging element must be delivered rapidly through the delivery line with each application of paint by the paint applicator to the substrate. Thus, the pigging element is subject to wear and must be replaced if worn. Further, lubrication of the delivery line with purging solvent also reduces the pressure required to push the pigging element through the supply line by the paint from the source of paint. Finally, delivery of a small volume of purging solvent to the supply line ahead or upstream of the pigging element or elements provides further cleaning of the paint residue remaining in the supply line from the previous application. This advantage is of particular importance where the paint delivered to the paint applicator by the paint delivery and application apparatus of this invention is different from the paint previously delivered in the prior application. It has been found that only a very small volume of purging solvent is required for this application, preferably less than about 50 ml or preferably between 5 and 30 ml or in most applications, between 5 and 20 ml. The purging solvent may be any conventional purging solvent, such as deionized water or any other conventional purging solvent.

In one preferred embodiment, the paint delivery and application apparatus includes a first pig station adjacent the source of paint under pressure and a second pig station adjacent the paint applicator, wherein the pigging element is delivered from the first pig station adjacent the source of paint and the second pig station adjacent the paint applicator. The second pig station may also be located within the paint applicator, particularly where the paint applicator is a rotary atomizer. The source of paint under pressure may be a paint switching device or color changer, but in the disclosed embodiment, the source of paint is a paint cannister having a piston which drives paint from the paint cannister through the supply line and receives paint through a second supply line from a color changer or paint switching device providing very accurate metering of paint delivered to the paint applicator. As disclosed in the above-referenced PCT application, the disclosure of which is incorporated by reference, the paint delivery and application system of this invention may include at least two paint cannisters, each connected to a color changer, such that one paint cannister is being filled with the paint while the other paint cannister is delivering paint under pressure to the paint applicator as described.

In one preferred embodiment of the paint delivery and application apparatus of this invention, the delivery line between the source of paint and the paint applicator includes two pigging elements including a first pigging element initially located adjacent the source of paint and a second pigging element adjacent the first pigging element and a small volume of purging solvent is delivered upstream of the second pigging element as described above. The source of paint under pressure then drives the first and second pigging elements from adjacent the source of paint to adjacent the paint applicator, thereby delivering paint to the paint applicator. As set forth above, the paint delivery and application apparatus of this invention preferably includes a first pig station adjacent the source of paint and a second pig station adjacent the paint applicator. The first and second pigging elements are thus first received in the first pig station prior to delivery of paint from the source of paint to the paint applicator and the pigging elements are then driven from adjacent the source of paint to the second pig station by the paint received from the source of paint.

As will be understood, the terms "first" pigging element and "second" pigging element are arbitrary terms used for purposes of description only. As used herein, the first pigging element is located adjacent the source of paint when the pigging elements are driven from adjacent the source of paint to adjacent the paint applicator, regardless of the relative location of the pigging elements in the first pig station. The second pigging element is then located upstream of the first pigging element. In a preferred embodiment of the pigging elements, the pigging elements include an annular skirt portion having an outer diameter greater than an internal diameter of the delivery line, such that the pigging elements scrape and clean the delivery line as the pigging elements are delivered from adjacent the source of paint to the paint applicator. As further disclosed in the above-referenced PCT application, the pigging elements are then be returned or shuttled from the second pig station back to the first pig station by pneumatic pressure through the delivery line for application of a second paint. Thus, the pigging elements are reversibly moveable back and forth in the delivery line between the first and second pig stations. Alternatively, as described in the prior art, the pigging element or pigging elements may be removed from the delivery line and returned to the first pig station.

In one preferred embodiment of this invention, a predetermined volume of purging solvent is delivered between the pigging elements when the pigging elements are located adjacent the paint applicator or in the second pig station. After the delivery of paint to the paint applicator as described above, the first and second pigging elements with purging solvent therebetween is then delivered by pneumatic pressure from the second pig station adjacent the paint applicator to the first pig station adjacent the source of paint under pressure, driving paint in the supply line back to the source of paint and purging the supply line with purging solvent. Thus, the pigging elements are reversibly moveable back and forth in the supply line between the first and second pig stations. In the disclosed embodiment of this invention, wherein the source of paint under pressure is a paint cannister having a reciprocable piston, as described above, most of the purging solvent between the pigging elements is then delivered to the paint cannister and the piston is withdrawn to accept the purging solvent, purging the supply line and the paint cannister. The piston is then extended to drive the purging solvent through the delivery line between the color changer and the paint cannister to purge this delivery line. In one preferred embodiment of this invention, a small volume of the purging solvent between the pigging elements is also delivered upstream or ahead of the second pigging element as described above prior to delivery of paint from the source of paint to the paint applicator. In the disclosed embodiment, the delivery line includes a small trunk line receiving purging solvent from between the pigging elements to adjacent the second pigging element upstream of the second pigging element as the pigging elements are driven together under pneumatic pressure, delivering solvent to the paint cannister.

The method of delivering and applying a paint to a substrate using a paint delivery and application apparatus of this invention thus includes delivering a small volume of purging solvent from a source of purging solvent to the delivery line adjacent to the pigging element and upstream of the pigging element while the pigging element is located adjacent the source of paint and the method then includes driving the pigging element preferably with paint from the adjacent source of paint to adjacent the paint applicator, thereby delivering paint to the paint applicator and applying paint to a substrate. Alternatively, the pigging element may be delivered through the delivery line under pneumatic pressure, for example. As set forth above, the source of paint may be a paint cannister having a piston connected to a color changer, wherein the method includes delivering paint from the color changer to the paint cannister, then driving paint from the paint cannister to the delivery line by moving the piston. Further, as described above, the delivery line may include two pigging elements, including a first pigging element adjacent the source of paint and a second pigging element adjacent the first pigging element, wherein the method of this invention includes delivering a small volume of purging solvent upstream of the second pigging element, then delivering paint to the delivery line, thereby driving the first and second pigging elements through the delivery line from adjacent the source of paint to adjacent the paint applicator to apply paint to a substrate. As will be understood from the above description, the term "upstream" means ahead of the pigging element in the direction of movement of the pigging element which, in the disclosed embodiment is toward the paint applicator, such that the purging solvent acts as a lubricant as the pigging element or pigging elements move through the delivery line, preventing chattering, skipping or jumping of the pigging element in the delivery line, reducing wear of the pigging element and the pressure required to push the pigging element through the delivery line and providing improved cleaning of the delivery line of residue paint.

In one preferred embodiment, the method of this invention includes delivering a predetermined volume of solvent between the pigging elements when the pigging elements are located adjacent the paint applicator or in the second pig station, driving the pigging elements with solvent therebetween from adjacent the paint applicator to adjacent the source of paint which, in the disclosed embodiment, is the first pig station, then driving a small volume of purging solvent from between the pigging elements to the delivery line upstream of the second pigging element to lubricate the delivery line as described above. In the disclosed embodiment, the method of this invention further includes delivering a substantial majority of the purging solvent from between the pigging elements to a paint cannister having a reciprocable piston to purge the paint cannister. Further, in the disclosed embodiment, the delivery line includes a trunk line in the first registration extending from between the pigging elements when the pigging elements are located in the first pig station extending back to the delivery line upstream of the second pigging element and the method then includes driving the pigging elements together, preferably under pneumatic pressure, thereby delivering a small volume of purging solvent through the trunk line upstream of the second pigging element.

As will be understood by those skilled in this art, various modifications may be made to the paint delivery and application apparatus and method of this invention within the purview of the appended claims. The following description of the preferred embodiments are provided for illustrative purposes only and, except as set forth in the appended claims, do not limit the scope of this invention.

DESCRIPTION OF THE PREFERRED EMBODIMENTS

Figure 1:
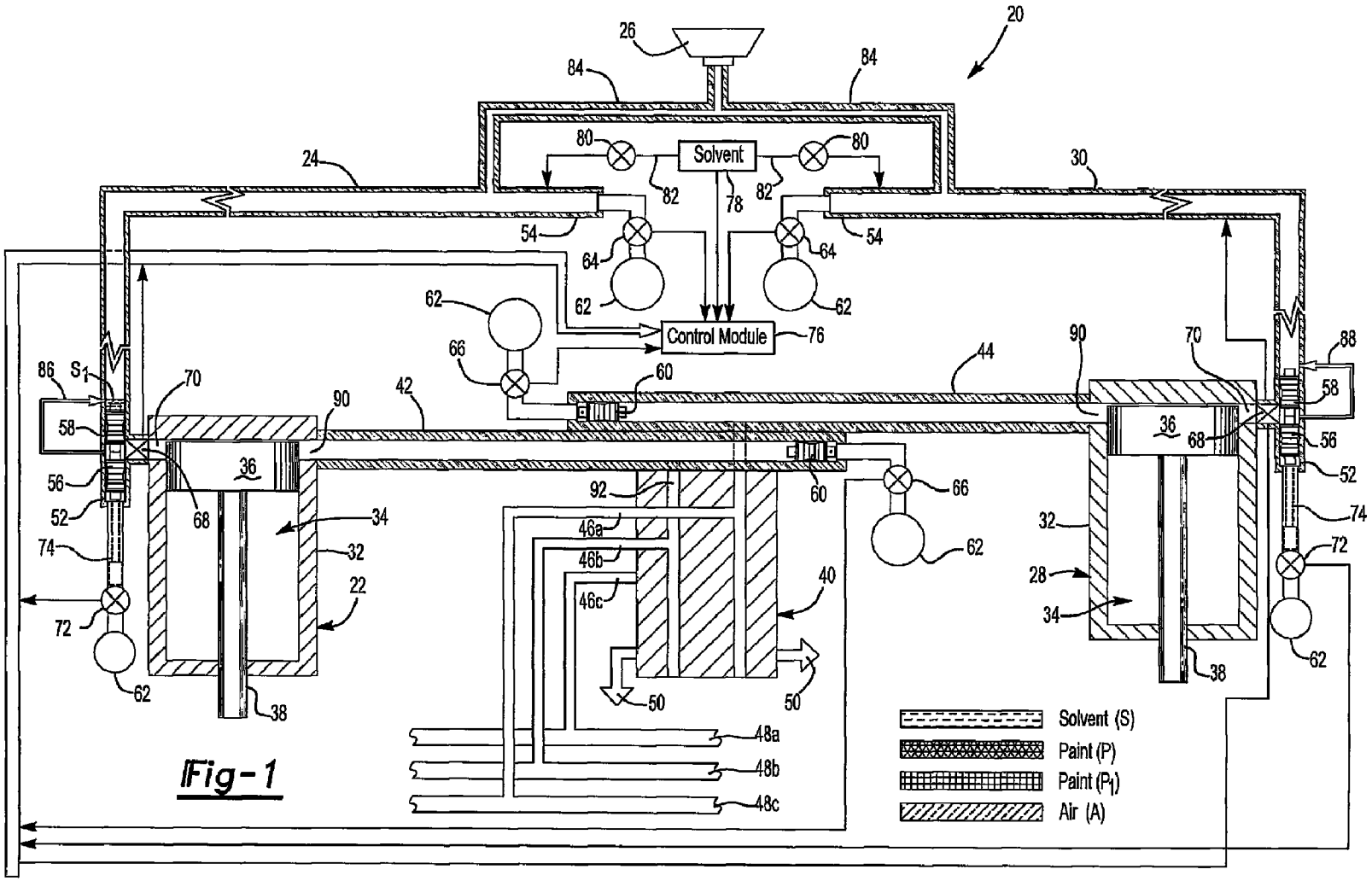
FIG. 1 is a partially schematic illustration of one embodiment of a paint delivery and application apparatus of this invention.

FIG. 1 illustrates one embodiment of a paint delivery and application apparatus 20 of this invention suitable for the method of delivering and applying a paint to a substrate of this invention. However, the apparatus 20 illustrated in FIG. 1 is provided for illustrative purposes only and does not limit the method and apparatus of this invention except as set forth in the appended claims. The disclosed apparatus 20 includes a first source of paint under pressure 22 connected by a first delivery line 24 to a paint applicator 26 and a second source of paint under pressure 28 connected by a second delivery line 30 to the paint applicator 26. The paint applicator 26 in this embodiment of the invention may be an electrostatic rotary paint atomizer available from the assignee of this application. However, any paint applicator may be utilized with the apparatus and method of this invention. In the disclosed embodiment, the first and second sources of paint under pressure 22 and 28, respectively, are paint cannisters including a housing 32, preferably formed of a nonconductive material, such as ceramic, enclosing a chamber 34 and a piston having a piston head 36 connected to a piston rod 38 which reciprocates through the chamber 34 as described further below. As described further in the above-referenced PCT application, the piston rod 38 is preferably connected to an electric servomotor (not shown) for accurate metering of paint from the paint cannisters to the paint applicator 26 as further described below. In the disclosed embodiment, the paint cannisters 22 and 28 are connected to a paint switching device 40, more commonly referred to as a color changer. The color changer 40 is connected by a first paint delivery line 42 to the first paint cannister 22 by line 42 and the color changer 40 is connected to the second paint cannister 28 by a second paint delivery line 44. As will be understood by those skilled in this art, a conventional color changer 40 is connected by a plurality of lines 46*a*, 46*b* and 46*c* (three of which are disclosed) to sources of colored paint 48*a*, 48*b* and 48*c*, respectively. A conventional color changer 40 also includes drains 50 for draining solvent and waste paint. Because the color changer 40 may be conventional and known in this art, no further description of color changer 40 is required for an understanding by those skilled in this art. It should be noted, however, that the color changer 40 must be at ground potential when applying a conductive paint, such as a water base paint, to a substrate with an electrostatic rotary atomizer.

The disclosed embodiment of the apparatus 20 includes a unique pigging system as now described. The first and second delivery lines 24 and 30 in the disclosed embodiment include a first pig station 52 adjacent the source of paint under pressure 22 and 28 and a second pig station 54 adjacent the paint applicator 26. As used herein, the term "adjacent" means closest to rather than next to because, for example, the second pig stations 54 may be located within a rotary atomizer shown at 26. The first and second delivery lines 24 and 30, respectively, further include two pigging elements, including a first pigging element 56 and a second pigging element 58 which are shuttled, or reversibly moved back and forth in the delivery line, between the first and second pig stations 52 and 54, respectively, as described below. In the disclosed embodiment, the first and second paint delivery lines 42 and 44 also include pigging elements 60. As described in co-pending applications of the assignee of this application and related companies, the pigging elements 56, 58 and 60 are preferably formed of a polymeric material having a central body portion including a sensor element, such as a magnet, for tracking the location of the pigging elements in the delivery lines, opposed outwardly extending frustoconical skirt portions spaced from the body portion and projecting end portions such that the pigging elements scrape the internal surfaces of the delivery lines of paint or purging solvent as the pigging elements are shuttled through the delivery lines. However, any pigging element may be utilized with the paint delivery and application apparatus and method of this invention.

The disclosed apparatus 20 further includes a source of pneumatic pressure 62 which, in FIG. 1, is shown as separate sources of pneumatic pressure. However, as will be understood by those skilled in this art, a common source of pneumatic pressure may be utilized. As used herein, the term "pneumatic pressure" includes any source of nonconductive gas, but typically will be air under pressure. In the disclosed embodiment, the apparatus further includes a plurality of valves, some of which are disclosed in FIG. 1 for ease of description of the operation of the apparatus and method of this invention. The disclosed embodiment of the apparatus includes valves 64 between the source of pneumatic pressure 62 and the second pig stations 54 adjacent the paint applicator 26 for driving the pigging elements 56 and 58 in the delivery lines 24 and 30 from the second pig stations 54 to the first pig stations 52. The disclosed apparatus further includes valves 66 between the source of pneumatic pressure 62 and the paint delivery lines 42 and 44 for driving the pigging elements 60 from adjacent the color changer 40 to the first and second sources of paint under pressure or paint cannisters 22 and 28, respectively, valves 68 at the outlet 70 of the paint cannisters 22 and 28, and valves 72 adjacent the first pig stations 52. As described below, the valves 72 are connected to the source of pneumatic pressure 62 to drive a push rod 74 through the first pig stations 52, driving the first and second pigging elements 56 and 58, respectively, beyond the outlet 70 of the paint cannisters 22 and 28. As shown in FIG. 1, the valves 64, 66, 68 and 72 are connected to a control module 76 for sequential opening and closing of the valves. The apparatus further includes a source of purging solvent under pressure 78 for delivering purging solvent to the second pig stations 54 between the first and second pigging elements 56 and 58, respectively, in the second pig station 54. Valves 80 are provided in the lines 82 between the source of purging solvent 78 and the second pig stations 54.

In the schematic illustration of the apparatus 20 in FIG. 1, lines 84 are connected between the paint applicator 26 and the first and second delivery lines 24 and 30, respectively, to deliver paint to the paint applicator 26. However, where the paint applicator 26 is an electrostatic rotary paint atomizer, the lines 84 and the second pig stations 54 may be located within the rotary atomizer. As will be understood, the valves 80 would also be controlled by the control module 76. Finally, as described in more detail hereinbelow, the first and second delivery lines 24 and 30, respectively, each include a small trunk line 86 and 88, respectively, between the first pig stations 52 and the delivery lines 24 and 30, respectively, delivering a small volume of purging solvent from between the first and second pigging elements 56 and 58, respectively, to the delivery lines 24 and 30, respectively, upstream of the second pigging element 58 and preferably adjacent the second pigging element prior to movement of the pigging elements 56 and 58 from the first pig stations 52 to the second pig stations 54 to lubricate the passage of the pigging elements 56 and 58 through the delivery lines 24 and 30, eliminate skipping or jumping of the pigging elements, reduced wear of the pigging elements and providing more accurate metering of the paint through the delivery lines as also discussed above. Having described one preferred embodiment of a paint delivery and application apparatus of this invention, the operation and method of this invention may now be described with reference to FIGS. 9 to 12.

Figure 2:
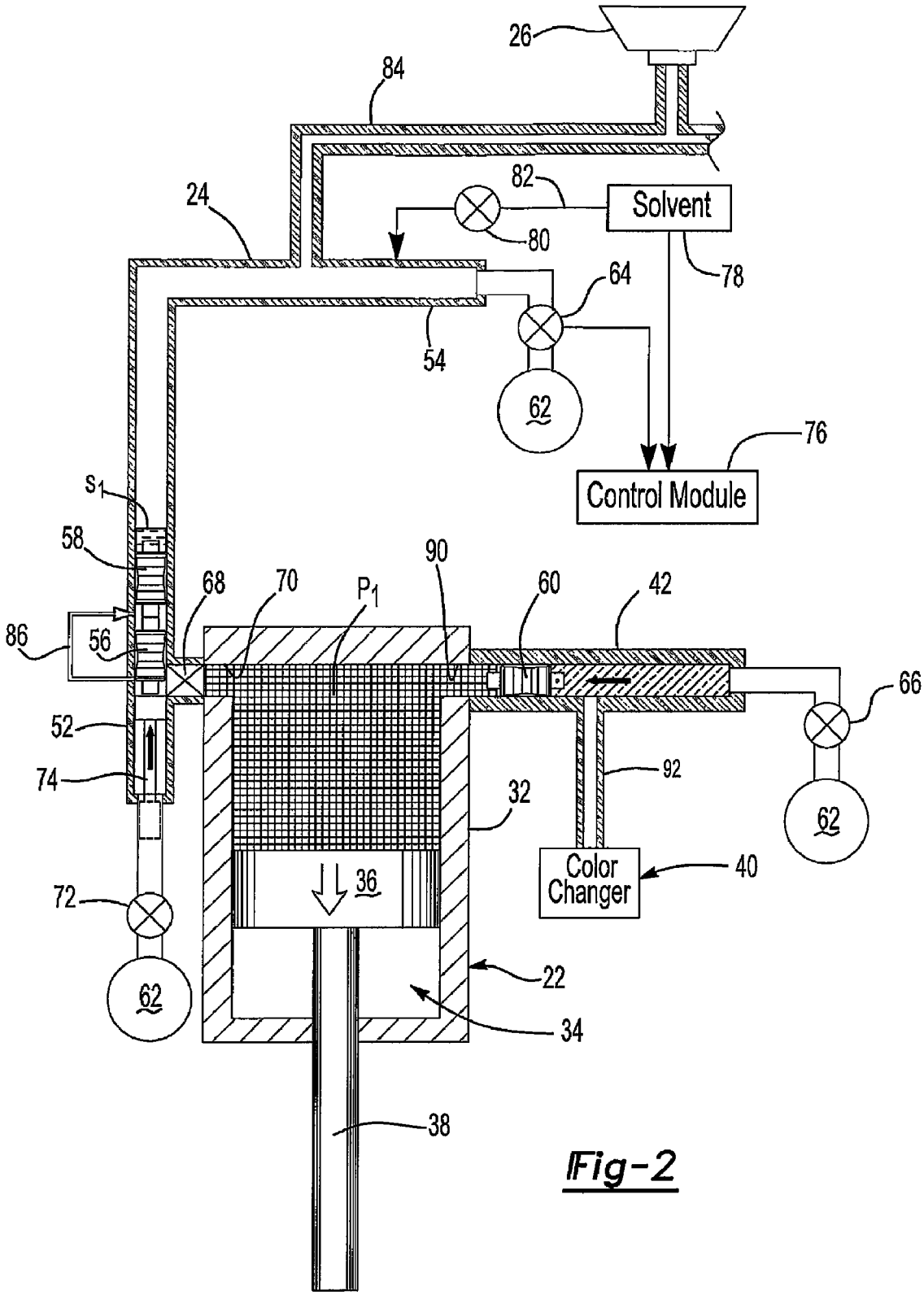
FIGS. 2 to 4 are a partial illustration of the left hand portion of the apparatus illustrated in FIG. 1 illustrating the delivery of paint to a paint applicator with the apparatus illustrated in FIG. 1.
Figure 3:
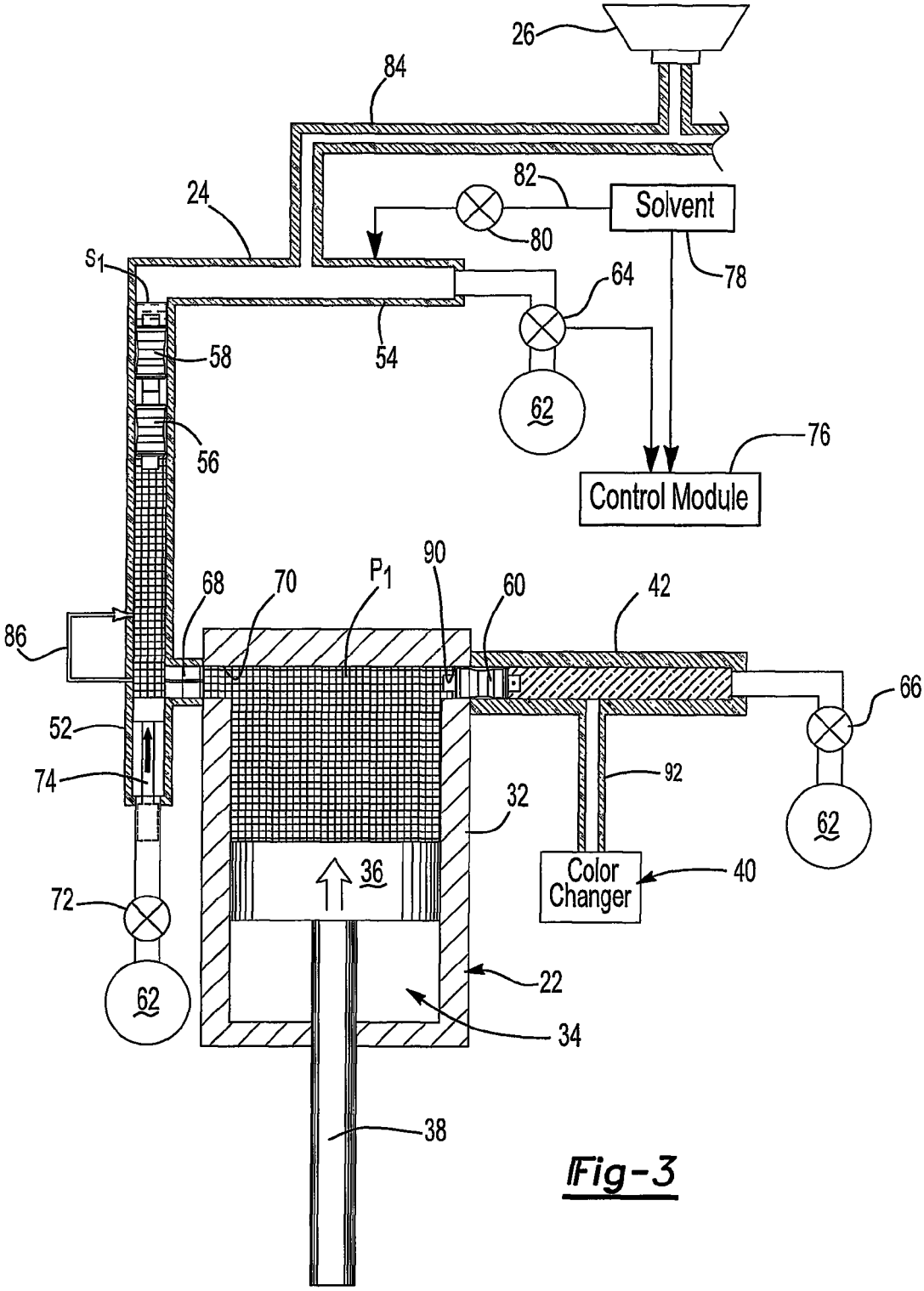
Figure 4:
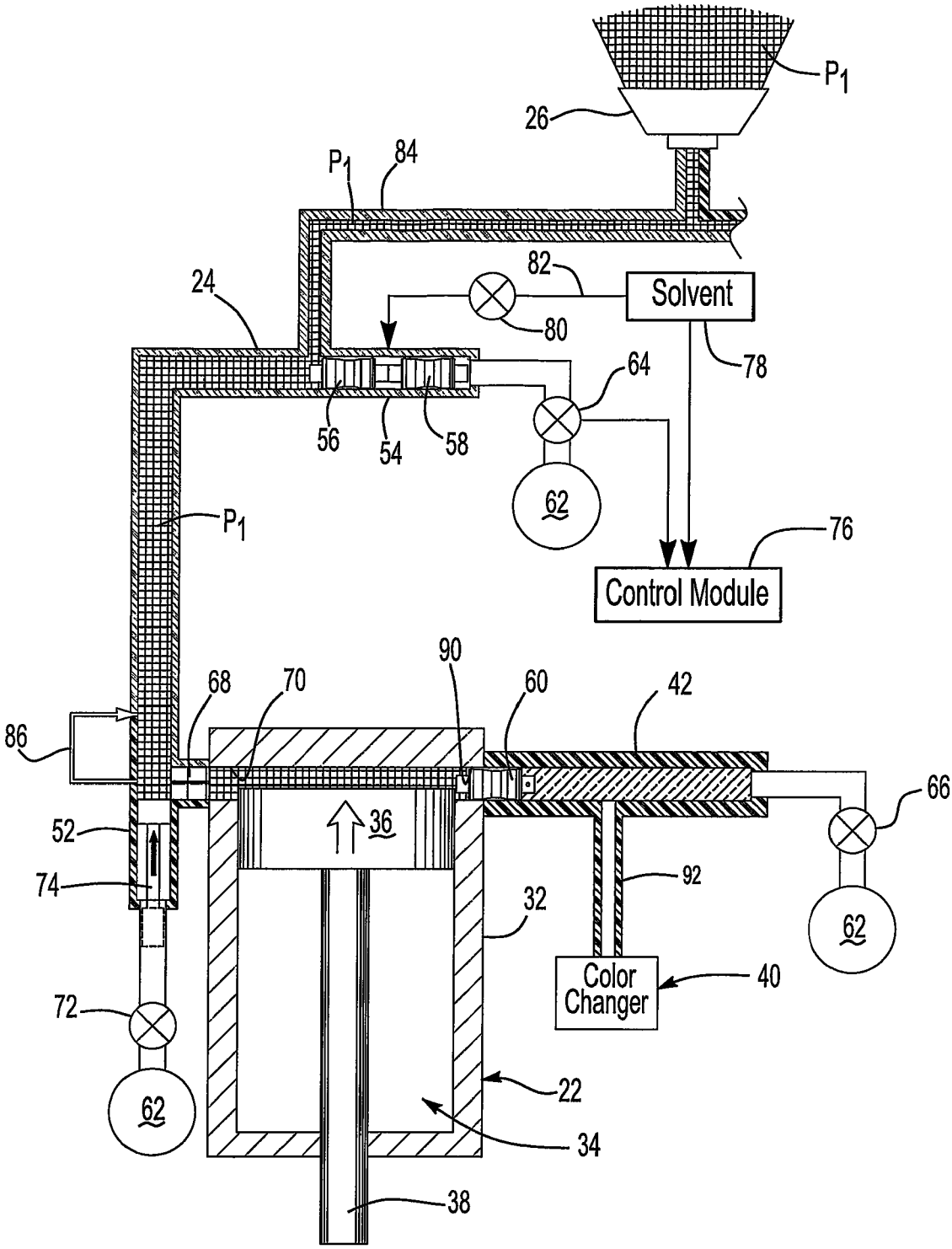

FIGS. 2 to 4 illustrate the delivery of a first paint $P_1$ from the first source of paint under pressure or paint cannister 22 to the paint applicator 26 with the apparatus 20 illustrated in FIG. 1. That is, FIGS. 2 to 4 illustrate only the left hand portion of FIG. 1 including the first source of paint under pressure or paint cannister 22, the paint applicator 26 and the first delivery line 24 between the paint cannister 22 and the paint applicator 26. As described in the above-referenced co-pending PCT application and discussed below, the paint cannisters 22 and 28 function in tandem such that a first paint is delivered from the first paint cannister 22 to the paint applicator 26 as the second paint cannister 28 is being filled with a second paint from the color changer 40 while the second paint cannister 28 is electrically isolated from the paint applicator 26 and the first paint cannister 22 is electrically isolated from the color changer, thereby reducing the time required for color changers and significantly increasing the efficiency of the paint delivery and application system. As described in more detail in the above-referenced co-pending PCT application, a first paint $P_1$ is received from the color changer 40 under pressure to the first paint delivery line 42 into the paint cannister 22 and the piston 36 is retracted to receive a predetermined "charge" of the first paint $P_1$. As set forth above, the piston rod 38 is preferably connected to an electric servomotor (not shown) to very accurately meter a predetermined volume of paint $P_1$ received by the paint cannister 22. At this time, the valve 68 at the outlet 70 of the paint cannister 22 is closed. The paint $P_1$ in the first paint delivery line 42 is then delivered to the paint cannister 22 by opening valve 66 delivering pneumatic pressure from the source of pneumatic pressure 62 to the first paint delivery line 42, driving the pigging element 60 to the inlet 90 of the paint cannister 22 as shown in FIG. 3.

As shown in FIG. 2, the first and second pigging elements 56 and 58 are driven by the push rod 74 by opening valve 72 to the source of pneumatic pressure 62 to beyond the outlet 70 of the paint cannister 22. During delivery of paint $P_1$ to the paint cannister 22, the valve 68 is closed. Upon delivery of a predetermined charge of paint $P_1$ to the paint cannister 22, the valve 68 is open and the piston 36 is reversed as shown in FIG. 3 driving paint through the delivery line 24 and the first and second pigging elements 56 and 58, respectively, from the first pig station 52 toward the second pig station 54. At this time, the valve 68 is open as shown in FIG. 3. As described below with regard to FIG. 11, a small volume of purging solvent $S_1$ is delivered upstream of the second pigging element 58 prior to movement of the pigging elements from the first pig station 52 for the reasons set forth above.

Figure 5:
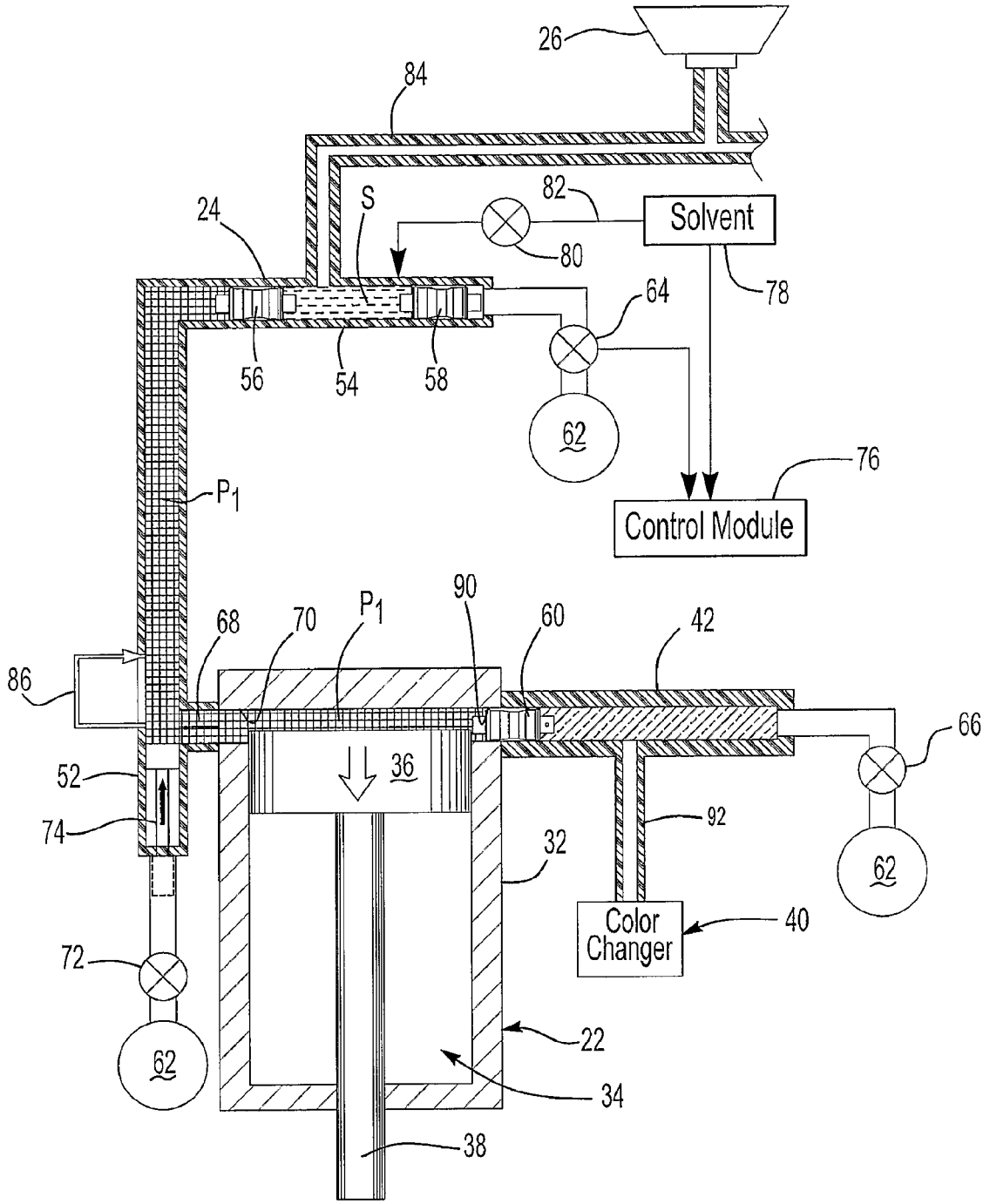
FIGS. 5 to 8 illustrate one method of returning paint from the paint applicator to the source of paint and purging of the delivery line with the apparatus illustrated in the prior figures.
Figure 6:
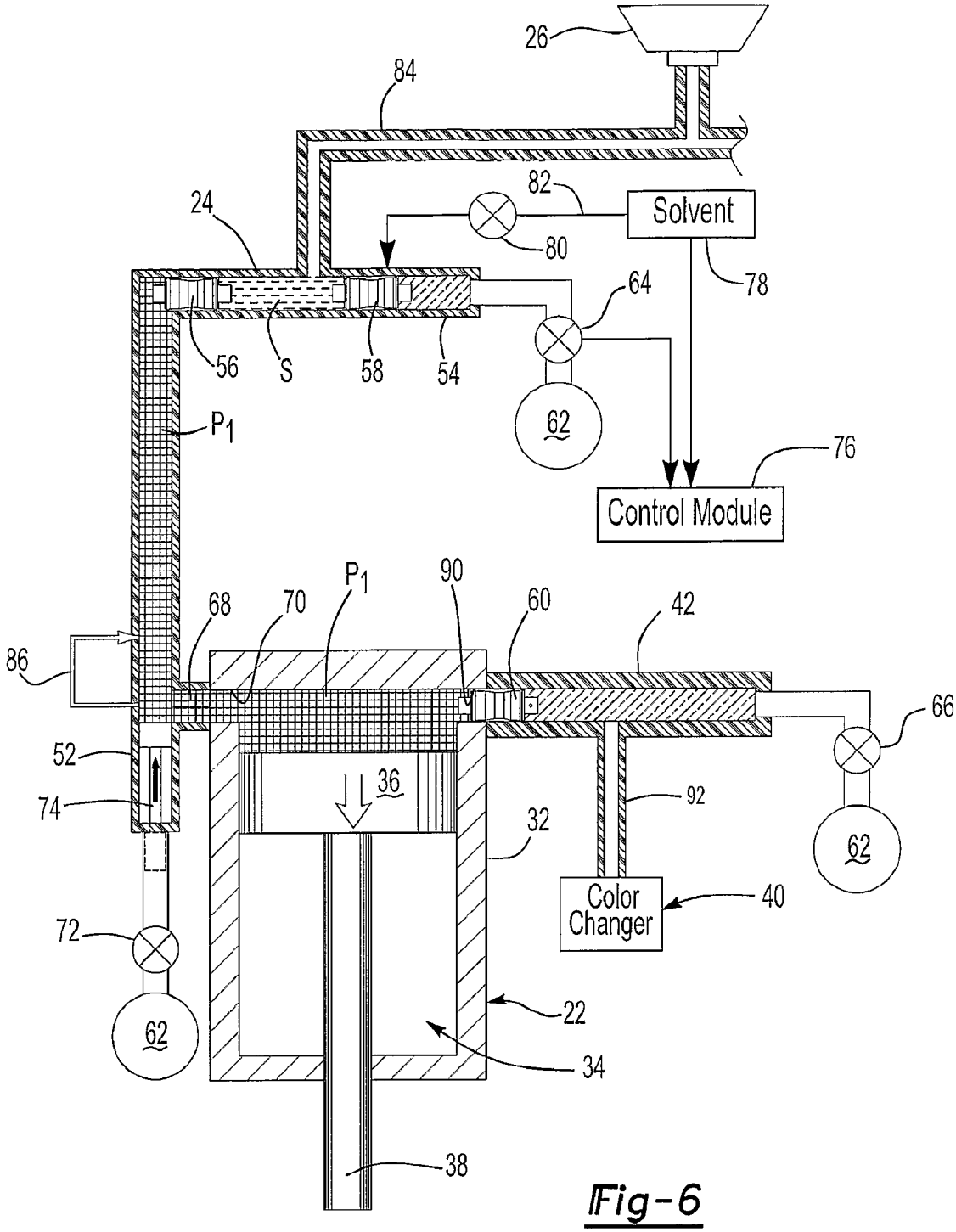
Figure 7:
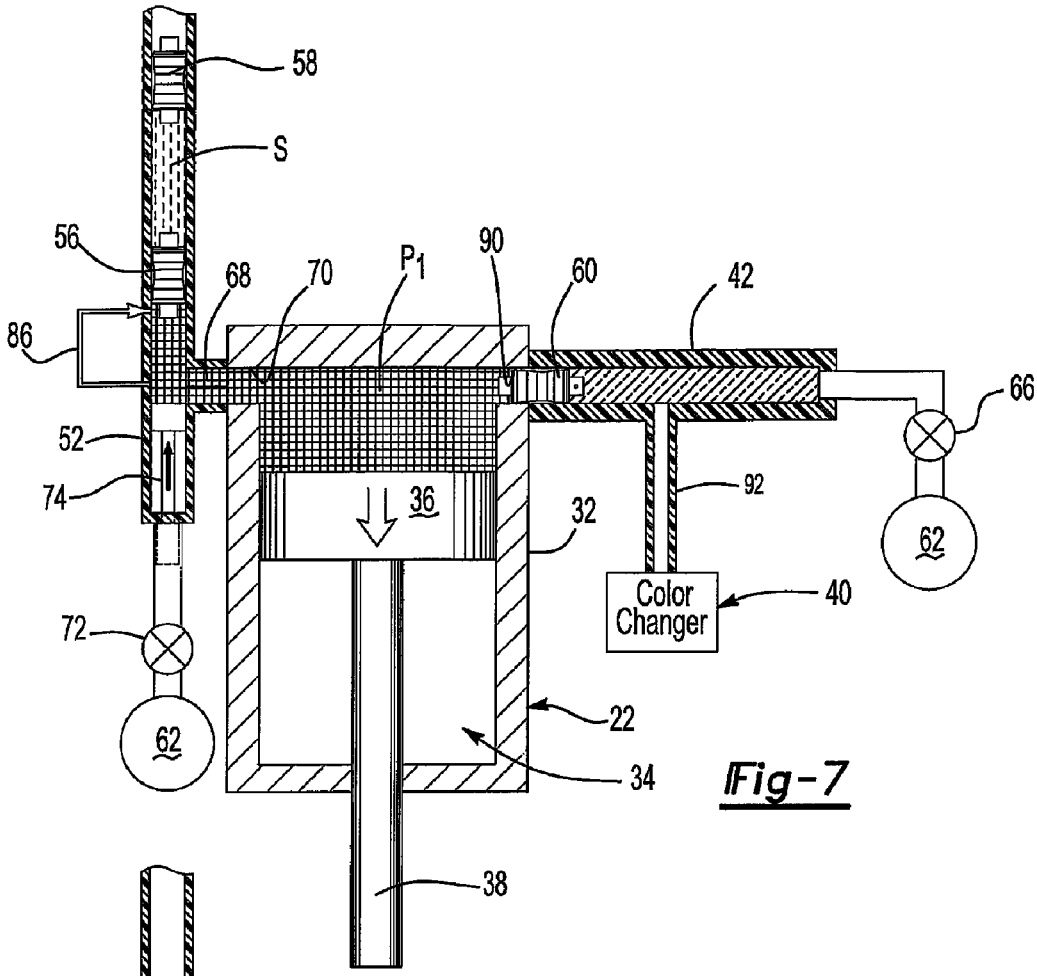

As shown in FIG. 4, the first and second pigging elements 56 and 58 are then driven into the second pig station 54 adjacent the applicator 26 and paint is then delivered to the paint applicator 26, applying the first paint $P_1$ to a substrate (not shown) through line 84. Upon completion of the delivery of the first paint $P_1$ to the paint applicator 26, a predetermined volume of purging solvent S is delivered to the second pig station 54 from the source of purging solvent 78 by opening valve 80. Alternatively, the solvent S may be delivered between the first and second pigging elements 56 and 58, respectively, during the paint cycle depending upon the size and configuration of the second pig station 54. The valve 64 to the source of pneumatic pressure 62 is then opened, driving the pigging elements 56 and 58 with purging solvent therebetween through the delivery line 24, driving the paint $P_1$ in the delivery line 24 toward the paint cannister 22 as shown in FIG. 6. The piston head 36 is simultaneously retracted as shown in FIGS. 5 to 7 to receive the excess paint $P_1$ in the first delivery line 24 in the paint cannister 22. As will be understood by those skilled in this art, the delivery lines 24 and 30 and the paint delivery lines 42 and 44 are preferably flexible tubes and the delivery lines 24 and 30 may extend fifteen meters or greater between the paint cannisters 22 and 28 and the paint applicator 26. Thus, the volume of paint $P_1$ in the delivery lines 24 and 30 will vary depending upon the length and diameter of the delivery lines 24 and 30.

Figure 8:
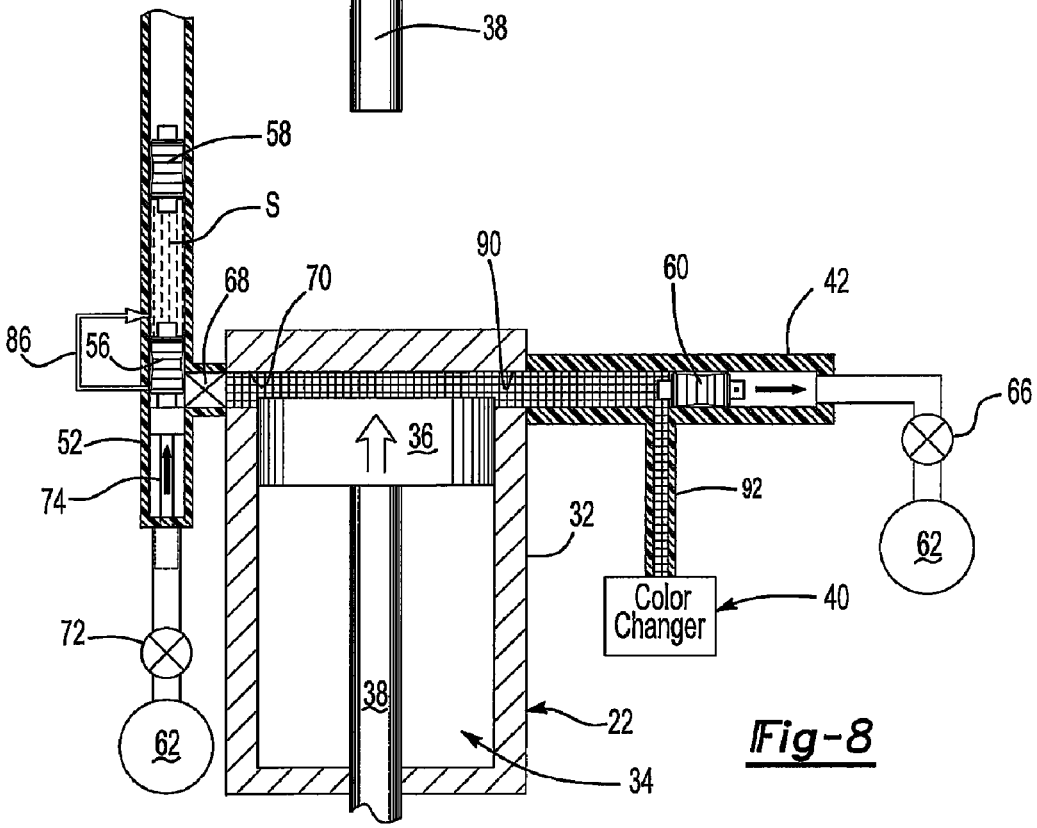

In FIGS. 6 and 7, the volume of paint $P_1$ received by the paint cannister 22 from the delivery line 24 has been exaggerated for clarity. During the recovery of paint $P_1$ from the delivery line 24, the pigging element 60 is located at the inlet 90 of the paint cannister 22, blocking the flow of paint $P_1$ to the first paint delivery line 42. When the first pigging element 52 reaches the opening 70 of the first paint cannister 22 as shown in FIG. 8, the piston is again reversed, driving the piston head 36 upwardly in FIG. 8, driving the pigging element 60 to the right in FIG. 8 back to the pig station adjacent the color changer 40 to deliver the first paint $P_1$ back to the color changer 40 through line 92. At this time, the valve 66 to the source of pneumatic pressure 62 is closed and remaining air in the first paint delivery line 42 is released.

Figure 9:
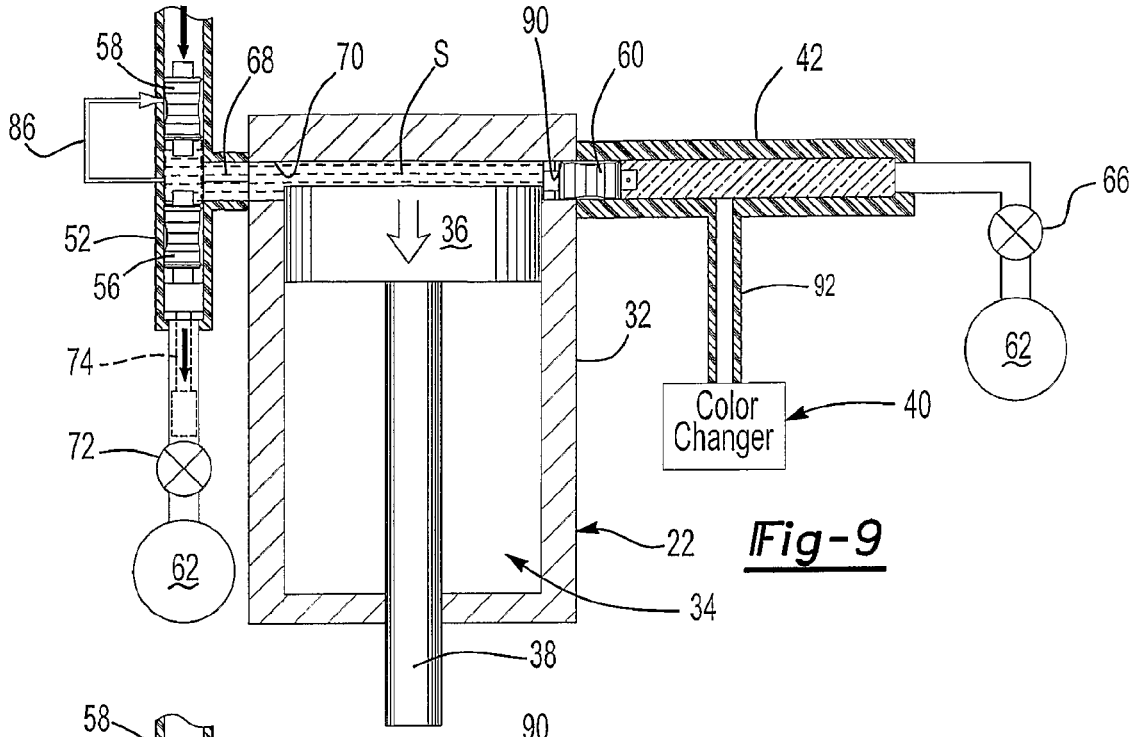
FIGS. 9 to 12 illustrate one embodiment of the method of purging the paint cannister and delivering a small volume of purging solvent upstream of the pigging elements with the apparatus illustrated in the prior figures.
Figure 10:
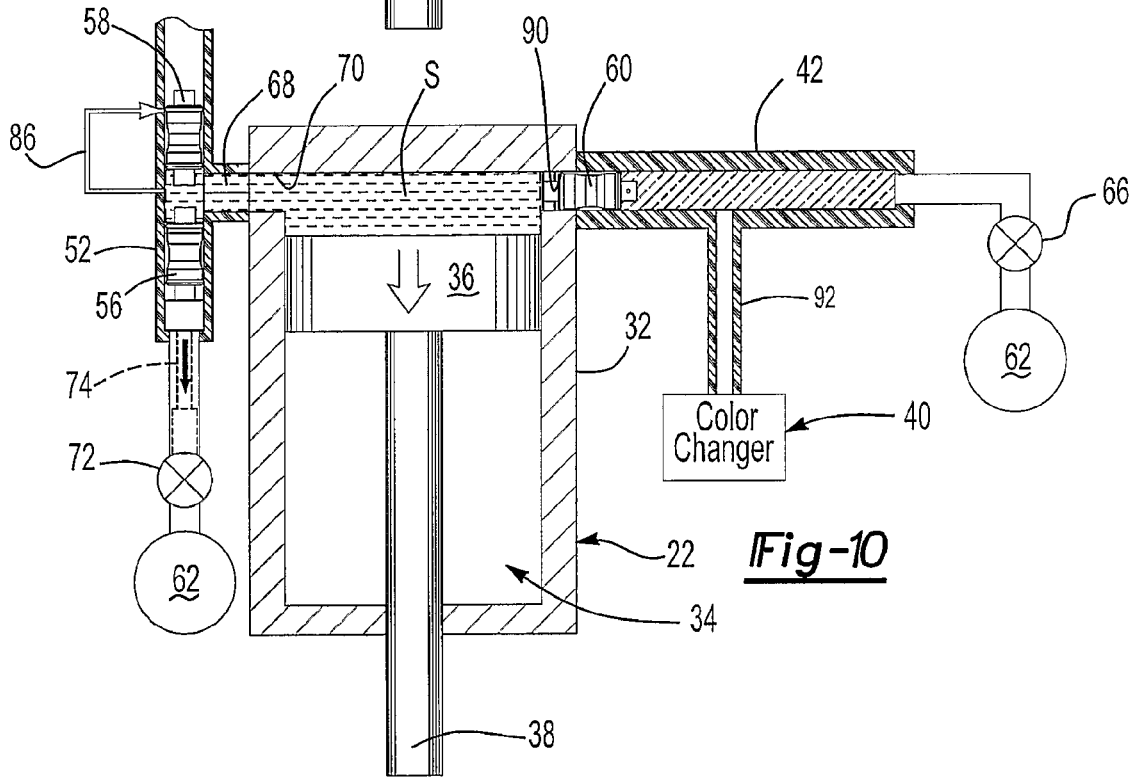
Figure 11:
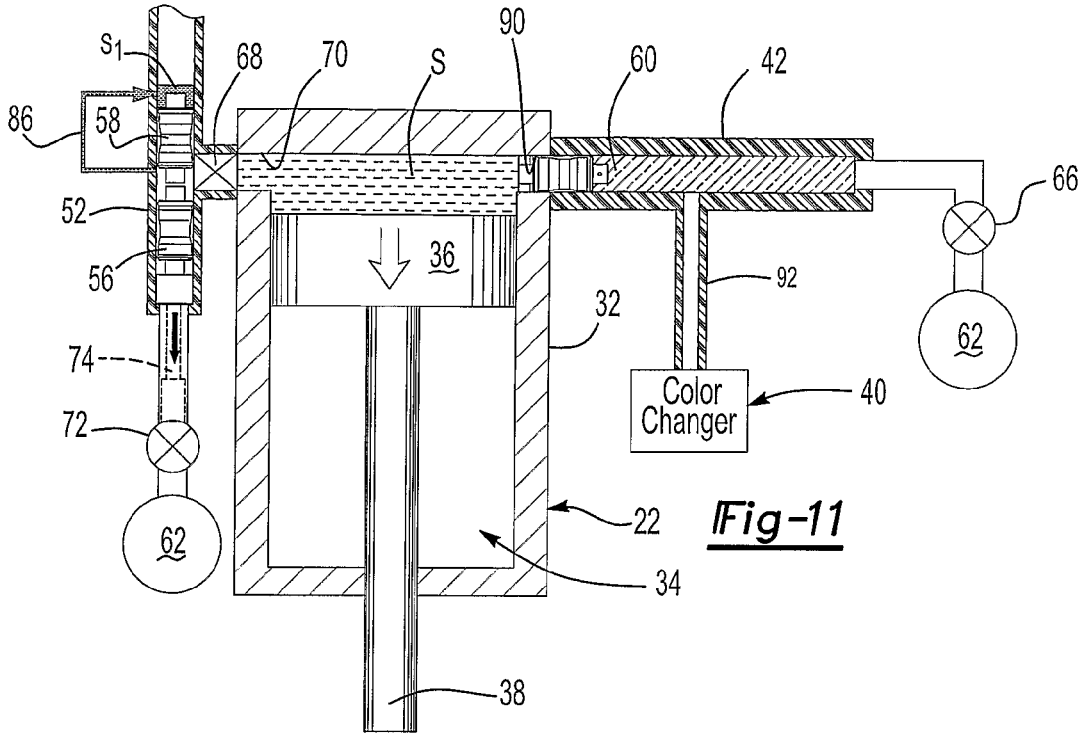

Upon delivery of the paint $P_1$ is the first delivery line 24 back to the color changer 40, the pigging element 60 in the first paint delivery line 42 is again delivered to the inlet 90 by opening valve 66 to the source of pneumatic pressure 62 blocking the inlet as shown in FIG. 9. The solvent S between the first and second pigging elements 56 and 58 is then delivered to the first paint cannister 22 as shown in FIGS. 9 and 10. Again, the volume of solvent S delivered to the first paint cannister 22 has been exaggerated in FIGS. 9 to 11 for clarity. During the delivery of solvent S to the first paint cannister 22, the piston head 36 is again retracted a predetermined distance to receive most, but not all of the solvent in the first paint cannister 22 as shown in FIG. 10. As shown in FIGS. 9 to 11, the push rod 74 is retracted a predetermined distance to locate the first pigging element 56 in the first pig chamber 52 and the second pigging element 58 is driven by pneumatic pressure from source 62 toward the first pigging element 56, finally driving a small volume of purging solvent $S_1$ from between, the first and second pigging elements 56 and 58, respectively, from the first pig station 52 back to the first delivery line 24 upstream of the second pigging element 56 as shown in FIG. 11. At this time, the valve 68 is closed.

Figure 12:
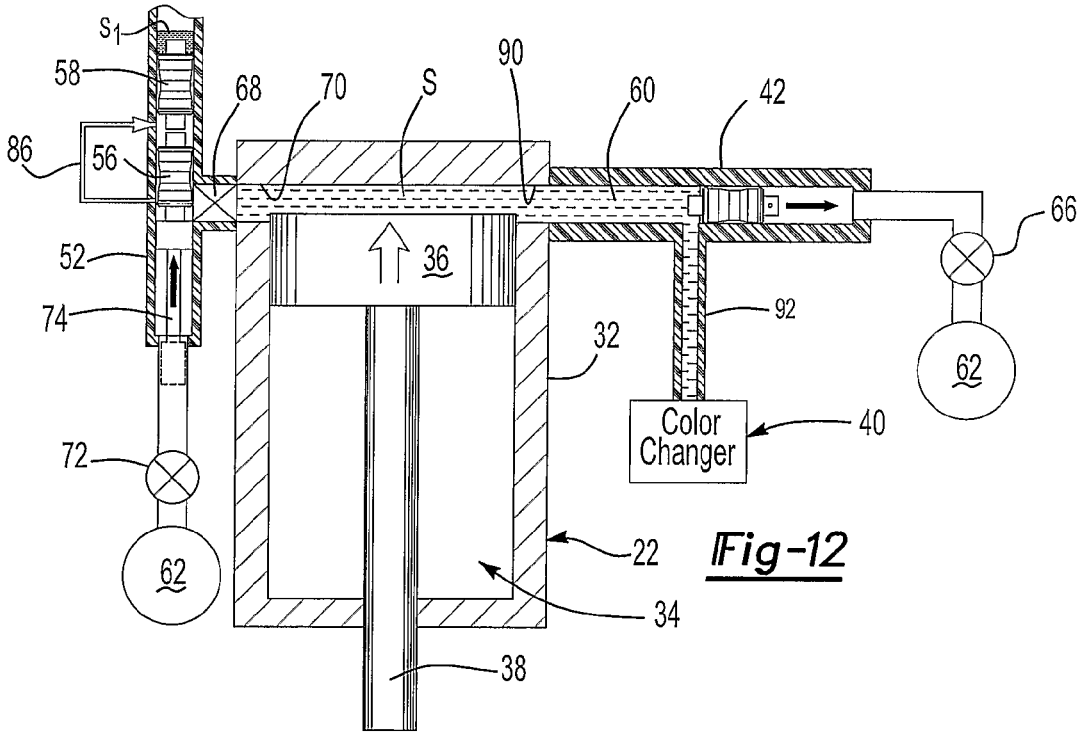

Thus, in one preferred embodiment of the method of this invention, a substantial majority of the purging solvents received between the first and second pigging elements 56 and 58, respectively, is delivered to the first paint cannister 22 to purge the paint cannister 22 and the paint delivery line 42 as shown in FIG. 12, but a small volume of purging solvent $S_1$ is delivered through trunk line 86 back to the first delivery line 24 upstream of the second pigging element 58 prior to moving the first and pigging elements 56 and 58, respectively, from the first pig station 52 adjacent the source of paint under pressure which, in the disclosed embodiment, is the paint cannister 32, to the second pig station 54 adjacent the paint applicator 26.

As set forth above, it has been found that delivery of a small volume of purging solvent $S_1$ upstream of a pigging element or pigging elements prior to driving the pigging elements through a delivery line substantially eliminates the problem of skipping or jumping of the pigging elements through the delivery line, results in more accurate metering of paint and reduces the wear of the pigging element or pigging elements, extending the life of the pigging element in such applications. This is particularly true where the pigging element or pigging elements are driven through the delivery line by an incompressible fluid, such as liquid paint or coating. Thus, the disclosed embodiment of the apparatus does not include delivering purging solvent ahead of the pigging elements 56 and 58 during delivery of the pigging elements from the second pig station 54 to the first pig station 52 because the pigging elements are driven by a compressible fluid, namely air or other nonconductive gas or compressible fluid. However, purging solvent may also be delivered ahead of the pigging element in the second pig station 54 depending upon the application. As also set forth above, only a very small volume of purging solvent is required for this application, preferably less than 50 ml or preferably between 5 and 30 ml or in most applications, between 5 and 20 ml. It will be understood, however, that the preferred volume of purging solvent delivered to the delivery line upstream of the pigging element or pigging elements will depend upon several factors, including but not limited to the inside diameter of the delivery line and the configuration of the pigging element. As used herein, the term "upstream" means a location in the direction of travel of the pigging element or pigging elements which, in the disclosed embodiment, is ahead of the second pigging element 58 or toward the paint applicator 26 from the first pig station 52 as best shown in FIG. 1.

Finally, FIG. 12 illustrates the final step in the purging cycle. The piston head 36 is again extended as shown in FIG. 12, driving the purging solvent S through the first paint delivery line to the color changer 40, purging the first paint delivery line 42 and the line 92 to the color changer 40. The purging solvent is then drained from the color changer 40 through one of drains 50. The valve 62 is closed and the line to the valve 62 is vented, such that the solvent S drives the pigging element 60 back to the pig station adjacent the color changer. The paint delivery and application apparatus is then ready for repeating the cycle described above with reference to FIGS. 2 to 12.

As set forth in further detail in the above-referenced PCT application, once the first paint $P_1$ is delivered to the first paint cannister 22 as shown, for example, in FIG. 3, the first paint cannister 22 is electrically isolated from the color changer 40. A second paint $P_2$ (not shown) may then be delivered from the color changer 40 to the second paint cannister 28 shown in FIG. 1, filling the paint cannister with a predetermined charge of paint as described above, wherein the piston head 36 is retracted as described. When the pigging element 60 in the second paint delivery line 44 is delivered to the inlet 90 of the second paint cannister 28, the second paint cannister is electrically isolated from the color changer 40) and paint then be delivered from the second paint cannister to the paint applicator 26 as described above. That is, the operation of the apparatus shown at the right in FIG. 1 is identical to the operation described above with regard to the first paint cannister 22 and no further description is required for a person of ordinary skill in this art to understand the complete operation of the paint delivery and application apparatus or system 20 disclosed in FIG. 1. As set forth above, the use of at least two paint cannisters 22 and 28 operating in sequence significantly reduces the time required for color change and improves the efficiency of the apparatus and method of this invention.

As will be understood by those skilled in this art, various modifications may be made to the paint delivery and application apparatus and method of this invention within the purview of the appended claims. First, this invention is not limited to the use of two pigging elements, but may be utilized in any coating delivery and application apparatus having at least one pigging element, but has particular advantage where the coating is an incompressible fluid or liquid coating which drives the pigging element or pigging elements as described. Further, the paint delivery and application apparatus and method of this invention may be utilized with any coating apparatus which delivers a coating from a source of coating under pressure to a coating applicator through a supply or delivery line, wherein the coating drives the pigging element through the supply line as described above. Thus, as set forth above, the term "paint" includes any liquid coating which "paints" or "coats" a substrate. The preferred purging solvent will depend upon the application, particularly including the paint or coating applied. Where the paint is a water base paint, deionized water is a suitable purging solvent. Finally, the terms "first" pig station and "second" pig station are arbitrary terms for purposes of description only and the term "pig station" merely defines a location of the pigging element or pigging elements as described above and is not limited to the pig stations disclosed. Having described one embodiment of the paint delivery and application apparatus and method of this invention, the invention is now claimed as follows.

The invention claimed is:

1. A paint delivery and application apparatus, comprising:

a source of paint under pressure;

a paint applicator adapted to apply paint to a substrate;

a supply line interconnecting said source of paint with said paint applicator;

at least one pigging element in said supply line reversibly moveable back and forth in said supply line between a first pig station adjacent said source of paint and a second pig station adjacent said paint applicator, wherein paint pushes said pigging element from said first pig station to said second pig station, delivering paint from said source of paint to said paint applicator; and a source of purging solvent delivering a small volume of purging solvent to said supply line adjacent said first pig station upstream of said pigging element when located in said first pig station sufficient to lubricate said supply line.

2. The paint delivery and application apparatus as defined in claim 1, wherein said source of purging solvent delivers between 5 and 50 ml of purging solvent to said supply line.

3. The paint delivery and application apparatus as defined in claim 1, wherein said purging solvent is deionized water.

4. The paint delivery and application apparatus as defined in claim 1, wherein said paint delivery and application apparatus includes two pigging elements in said supply line, said source of purging solvent connected to said second pig station delivering purging solvent between said pigging elements in said second pig station, a source of fluid under pressure connected to said second pig station driving said pigging elements with purging solvent therebetween from said second pig station to said first pig station, driving paint in said supply line to said source of paint and said supply line including a trunk line delivering a portion of said purging solvent between said pigging elements to said supply line upstream of said pigging elements.

5. The paint delivery and application apparatus as defined in claim 4, wherein said source of paint is a paint cannister having a reciprocating piston including an outlet delivering paint to said supply line and said pigging elements with purging solvent therebetween delivering solvent to said paint cannister purging said paint cannister.

6. The paint delivery and application apparatus as defined in claim 1, wherein said paint delivery and application apparatus includes at least two pigging elements in said supply line and said source of purging solvent delivering purging solvent to said supply line upstream of said pigging elements.

7. A paint delivery and application apparatus, comprising:

a source of paint under pressure;

a paint applicator adapted to apply paint to a substrate;

a supply line interconnecting said source of paint with said paint applicator;

at least two pigging elements in said supply line reversibly moveable back and forth in said supply line between a first pig station adjacent said source of paint and a second pig station adjacent said paint applicator, including a first pigging element adjacent said source of paint and a second pigging element adjacent said first pigging element when said first and second pigging elements are located in said first pig station; and a source of purging solvent delivering a small volume of purging solvent to said supply line adjacent said second pigging element upstream of said second pigging element prior to delivering paint from said source of paint to said supply line, said paint then driving said first and second pigging elements through said supply line from said first pig station to said second pig station, thereby delivering paint to said paint applicator.

8. The paint delivery and application apparatus as defined in claim 7, wherein said source of purging solvent delivers between about 5 and 50 ml of purging solvent to said supply line upstream of said second pigging element.

9. The paint delivery and application apparatus as defined in claim 7, wherein said source of purging solvent delivers between 5 and 30 ml of purging solvent to said supply line upstream of said second pigging element.

10. The paint delivery and application apparatus as defined in claim 7, wherein said source of paint is a paint cannister having a piston receiving paint from a color changer, said piston driving paint from said paint cannister against said first pigging element and delivering paint from said paint cannister to said paint applicator.

11. The paint delivery and application apparatus as defined in claim 7, wherein said source of purging solvent is connected to said second pig station delivering purging solvent between said pigging elements in said second pig station, a source of fluid connected to said second pig station driving said pigging elements with solvent therebetween from said second pig station to said first pig station, driving paint in said supply line to said source of paint and purging said supply line, and said supply line including a trunk line connected to said first pig station delivering a small portion of said purging solvent located between said pigging elements to said supply line upstream of said pigging elements.

12. The paint delivery and application apparatus as defined in claim 11, wherein said source of paint is a paint cannister having a reciprocating piston including an outlet delivering paint to said supply line and said outlet receiving purging solvent from between said first and second pigging elements upon receipt of said first and second pigging elements in said first pig station.

13. The paint delivery and application apparatus as defined in claim 7, wherein said first pig station includes a reciprocable push rod driving said pigging elements into said supply line beyond an outlet of said source of paint prior to receipt of paint from said source of paint to said supply line.

14. A method of delivering and applying a paint to a substrate using a paint delivery and application system including a source of paint under pressure, a paint applicator, a delivery line interconnecting said source of paint and said paint applicator, at least one pigging element in said delivery line reversibly moveable back and forth in said delivery line from adjacent said source of paint to adjacent said paint applicator, and a source of purging solvent, said method comprising the following steps in sequence:

delivering between 5 and 50 ml of purging solvent from said source of purging solvent to said delivery line adjacent said pigging element upstream of said pigging element while said pigging element is located adjacent said source of paint; and then delivering paint under pressure from said source of paint to said delivery line, thereby driving said pigging element from adjacent said source of paint to adjacent said paint applicator, delivering paint from said source of paint to said paint applicator and applying paint to a substrate.

15. The method of delivering and applying a paint to a substrate as defined in claim 14, wherein said paint delivery and application system includes at least two pigging elements in said delivery line, said method including locating said pigging elements adjacent one of said source of paint and said paint applicator, delivering purging solvent between said pigging elements, and then delivering said elements with purging solvent therebetween through said delivery line, thereby delivering purging solvent to said delivery line.

16. The method of delivering and applying a paint to a substrate as defined in claim 14, wherein said source of paint is a paint cannister having a reciprocable piston therein connected to a color changer, said method including delivering paint from said color changer to said paint cannister, then driving paint from said paint cannister to said delivery line.

17. The method of delivering and applying a paint to a substrate as defined in claim 14, wherein said paint delivery and application system includes at least two pigging elements in said delivery line, wherein said method includes locating said pigging elements adjacent said paint applicator, delivering purging solvent between said pigging elements, delivering said pigging elements with purging solvent therebetween from adjacent said paint applicator to adjacent said source of paint under pressure, then delivering said between 5 and 50 ml of purging solvent from between said pigging elements to said delivery line upstream of said pigging elements.

18. A method of delivering and applying a paint to a substrate using a paint delivery and applicator system including a source of paint under pressure, a paint applicator, a delivery line interconnecting said source of paint and said paint applicator, a first pig station adjacent said source of paint and a second pig station adjacent said paint applicator, at least two pigging elements in said delivery line reversibly moveable back and forth between said first and second pig stations through said delivery line, and a source of purging solvent, said method comprising the following steps in sequence:

delivering a small volume of purging solvent upstream of said pigging elements; and delivering paint under pressure from said source of paint to said delivery line, thereby driving said pigging elements in said first pig station to said second pig station, thereby delivering paint from said source of paint to said paint applicator and said paint applicator then applying paint to a substrate.

19. The method of delivering and applying a paint to a substrate as defined in claim 18, wherein said source of paint is a paint cannister connected to a color changer, said method including delivering said paint from said color changer to said paint cannister, then driving paint from said paint cannister to said paint applicator through said delivery line.

20. A paint delivery and application apparatus, comprising:
a source of paint under pressure;
a paint applicator adapted to apply paint to a substrate;
a supply line interconnecting said source of paint with said paint applicator;
at least one pigging element in said supply line moveable between a first pig station adjacent said source of paint and a second pig station adjacent said paint applicator, wherein paint pushes said pigging element from said first pig station to said second pig station, delivering paint from said source of paint to said paint applicator; and
a source of purging solvent delivering a small volume of purging solvent to said supply line adjacent said first pig station upstream of said pigging element when located in said first pig station sufficient to lubricate said supply line;
wherein said paint delivery and application apparatus includes two pigging elements in said supply line, said source of purging solvent connected to said second pig station delivering purging solvent between said pigging elements in said second pig station, a source of fluid under pressure connected to said second pig station driving said pigging elements with purging solvent therebetween from said second pig station to said first pig station, driving paint in said supply line to said source of paint and said supply line including a trunk line delivering a portion of said purging solvent between said pigging elements to said supply line upstream of said pigging elements; and
wherein said source of paint is a paint cannister having a reciprocating piston including an outlet delivering paint to said supply line and said pigging elements with purging solvent therebetween delivering solvent to said paint cannister purging said paint cannister.

21. A paint delivery and application apparatus, comprising:
a source of paint under pressure;
a paint applicator adapted to apply paint to a substrate;
a supply line interconnecting said source of paint with said paint applicator;
at least two pigging elements in said supply line moveable between a first pig station adjacent said source of paint and a second pig station adjacent said paint applicator, including a first pigging element adjacent said source of paint and a second pigging element adjacent said first pigging element when said first and second pigging elements are located in said first pig station; and
a source of purging solvent delivering a small volume of purging solvent to said supply line adjacent said second pigging element upstream of said second pigging element prior to delivering paint from said source of paint to said supply line, said paint then driving said first and second pigging elements through said supply line from said first pig station to said second pig station, thereby delivering paint to said paint applicator;
wherein said source of paint is a paint cannister having a piston receiving paint from a color changer, said piston driving paint from said paint cannister against said first pigging element and delivering paint from said paint cannister to said paint applicator.

22. A paint delivery and application apparatus, comprising:
a source of paint under pressure;
a paint applicator adapted to apply paint to a substrate;
a supply line interconnecting said source of paint with said paint applicator;
at least two pigging elements in said supply line moveable between a first pig station adjacent said source of paint and a second pig station adjacent said paint applicator, including a first pigging element adjacent said source of paint and a second pigging element adjacent said first pigging element when said first and second pigging elements are located in said first pig station; and
a source of purging solvent delivering a small volume of purging solvent to said supply line adjacent said second pigging element upstream of said second pigging element prior to delivering paint from said source of paint to said supply line, said paint then driving said first and second pigging elements through said supply line from said first pig station to said second pig station, thereby delivering paint to said paint applicator;
wherein said source of purging solvent is connected to said second pig station delivering purging solvent between said pigging elements in said second pig station, a source of fluid connected to said second pig station driving said pigging elements with solvent therebetween from said second pig station to said first pig station, driving paint in said supply line to said source of paint and purging said supply line, and said supply line including a trunk line connected to said first pig station delivering a small portion of said purging solvent located between said pigging elements to said supply line upstream of said pigging elements, and
wherein said source of paint is a paint cannister having a reciprocating piston including an outlet delivering paint to said supply line and said outlet receiving purging solvent from between said first and second pigging elements upon receipt of said first and second pigging elements in said first pig station.

23. A paint delivery and application apparatus, comprising:
a source of paint under pressure;
a paint applicator adapted to apply paint to a substrate;
a supply line interconnecting said source of paint with said paint applicator;
at least two pigging elements in said supply line moveable between a first pig station adjacent said source of paint and a second pig station adjacent said paint applicator, including a first pigging element adjacent said source of paint and a second pigging element adjacent said first pigging element when said first and second pigging elements are located in said first pig station; and
a source of purging solvent delivering a small volume of purging solvent to said supply line adjacent said second pigging element upstream of said second pigging element prior to delivering paint from said source of paint to said supply line, said paint then driving said first and second pigging elements through said supply line from said first pig station to said second pig station, thereby delivering paint to said paint applicator;
wherein said first pig station includes a reciprocable push rod driving said pigging elements into said supply line beyond an outlet of said source of paint prior to receipt of paint from said source of paint to said supply line.

24. A method of delivering and applying a paint to a substrate using a paint delivery and application system including a source of paint under pressure, a paint applicator, a delivery line interconnecting said source of paint and said paint applicator, at least one pigging element in said delivery line moveable in said delivery line from adjacent said source of paint to adjacent said paint applicator, and a source of purging solvent, said method comprising the following steps in sequence:
delivering between 5 and 50 ml of purging solvent from said source of purging solvent to said delivery line adjacent said pigging element upstream of said pigging element while said pigging element is located adjacent said source of paint; and then delivering paint under pressure from said source of paint to said delivery line, thereby driving said pigging element from adjacent said source of paint to adjacent said paint applicator, delivering paint from said source of paint to said paint applicator and said paint applicator and applying paint to a substrate;

wherein the source of paint is a paint cannister having a reciprocable piston therein connected to a color changer, and said method includes delivering paint from the color changer to the paint cannister, then driving paint from the paint cannister to the delivery line.

25. A method of delivering and applying a paint to a substrate using a paint delivery and applicator system including a source of paint under pressure, a paint applicator, a delivery line interconnecting said source of paint and said paint applicator, a first pig station adjacent said source of paint and a second pig station adjacent said paint applicator, at least two pigging elements in said delivery line moveable between said first and second pig stations through said delivery line, and a source of purging solvent, said method comprising the following steps in sequence:

delivering a small volume of purging solvent upstream of said pigging elements; and delivering paint under pressure from said source of paint to said delivery line, thereby driving said pigging elements in said first pig station to said second pig station, thereby delivering paint from said source of paint to said paint applicator and said paint applicator then applying paint to a substrate;

wherein the source of paint is a paint cannister connected to a color changer, and said method includes delivering paint from the color changer to the paint cannister, then driving paint from the paint cannister to the paint applicator through the delivery line.

* * * * *